US012000241B2

(12) United States Patent
Underbrink et al.

(10) Patent No.: US 12,000,241 B2
(45) Date of Patent: Jun. 4, 2024

(54) ELECTRONIC RUPTURE DISC WITH ATMOSPHERIC CHAMBER

(71) Applicant: Schlumberger Technology Corporation, Sugar Land, TX (US)

(72) Inventors: Michael Underbrink, Eureka, MO (US); Yann Dufour, Houston, TX (US); Kaiyang Kevin Liew, Houston, TX (US); Joao Mendonca, Rosharon, TX (US); Oguzhan Guven, Bellaire, TX (US); Laurent Alteirac, Missouri city, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 94 days.

(21) Appl. No.: 17/904,029

(22) PCT Filed: Feb. 18, 2021

(86) PCT No.: PCT/US2021/018451
§ 371 (c)(1),
(2) Date: Aug. 11, 2022

(87) PCT Pub. No.: WO2021/168032
PCT Pub. Date: Aug. 26, 2021

(65) Prior Publication Data

US 2023/0088984 A1 Mar. 23, 2023

(51) Int. Cl.
*E21B 33/12* (2006.01)
*E21B 34/06* (2006.01)
*E21B 47/18* (2012.01)

(52) U.S. Cl.
CPC ..... *E21B 34/063* (2013.01); *E21B 33/12* (2013.01); *E21B 34/066* (2013.01); *E21B 47/18* (2013.01)

(58) Field of Classification Search
CPC ..... E21B 33/12; E21B 34/063; E21B 34/066; E21B 47/18
See application file for complete search history.

(56) References Cited

U.S. PATENT DOCUMENTS 3,964,544 A 6/1976 Farley et al.
3,976,136 A 8/1976 Farley et al.
(Continued)

FOREIGN PATENT DOCUMENTS

GB 2541943 A 3/2017
WO 2009098498 A1 8/2009
(Continued)

OTHER PUBLICATIONS

International Search Report and Written Opinion issued in the PCT Application PCT/US2021/018451, dated Jun. 3, 2021 (11 pages).

*Primary Examiner* — Matthew R Buck
(74) *Attorney, Agent, or Firm* — Jeffrey D. Frantz

(57) ABSTRACT

An electronic trigger system includes a longitudinal housing including detection, electronics, and actuation sections disposed therein. The detection section includes a pressure sensor for receiving a predetermined pressure signal, and an electronic control board including at least one battery is disposed in the electronics section. The actuation section includes a prefill chamber, a setting piston disposed in the prefill chamber, an actuation device, an atmospheric chamber, and a pressure port. A predetermined amount of prefilled fluid at hydrostatic pressure is trapped between the setting piston and the actuation device in the prefill chamber. The actuation device isolates the prefilled fluid at hydrostatic pressure in the prefill chamber from the atmospheric chamber. Actuation occurs when, upon receipt of the predetermined pressure signal by the pressure sensor, the electronic control board transmits power to the actuation device, caus-
(Continued)

ing the prefilled fluid to flow through the actuation device and into the atmospheric chamber.

16 Claims, 6 Drawing Sheets

(56) References Cited

U.S. PATENT DOCUMENTS 4,109,725 A 8/1978 Williamson et al.
4,444,268 A 4/1984 Barrington
4,667,743 A 5/1987 Ringgenberg et al.
5,188,183 A 2/1993 Hopmann et al.
5,518,073 A 5/1996 Manke et al.
5,810,087 A 9/1998 Patel
5,924,696 A 7/1999 Frazier
6,041,864 A 3/2000 Patel et al.
6,085,845 A 7/2000 Patel et al.
6,227,298 B1 5/2001 Patel
6,230,807 B1 5/2001 Patel
6,230,808 B1 5/2001 French et al.
6,244,351 B1 6/2001 Patel et al.
6,250,383 B1 6/2001 Patel
6,253,857 B1 7/2001 Gano
6,302,208 B1 10/2001 Walker et al.
6,302,216 B1 10/2001 Patel
6,354,378 B1 3/2002 Patel
6,439,306 B1 8/2002 Patel
6,494,269 B2 12/2002 French et al.
6,505,684 B2 1/2003 Rayssiguier et al.
6,523,613 B2 2/2003 Rayssiguier et al.
6,631,768 B2 10/2003 Patel et al.
6,634,429 B2 10/2003 Henderson et al.
6,662,877 B2 12/2003 Patel
6,691,785 B2 2/2004 Patel
6,945,331 B2 9/2005 Patel
7,252,152 B2 8/2007 LoGiudice et al.
7,303,020 B2 12/2007 Bishop et al.
7,337,850 B2 * 3/2008 Contant ..... E21B 34/066 166/66.6
7,347,272 B2 3/2008 Patel et al.
7,503,398 B2 3/2009 LoGiudice et al.
7,510,001 B2 * 3/2009 Spring ..... E21B 23/04 166/66.4
7,617,875 B2 11/2009 Darnell et al.
7,980,316 B2 7/2011 Swenson et al.
8,056,643 B2 11/2011 Basmajian et al.
8,113,286 B2 2/2012 Beall et al.
8,256,518 B2 9/2012 Guven et al.
8,261,817 B2 9/2012 Hayter et al.
8,286,717 B2 10/2012 Giroux et al.
8,365,832 B2 2/2013 Martin et al.
8,403,042 B2 3/2013 Green et al.
8,469,106 B2 6/2013 Caminari et al.
8,528,641 B2 9/2013 Clem et al.
8,567,515 B2 10/2013 Giroux et al.
8,602,105 B2 12/2013 Sinclair
8,684,099 B2 4/2014 Azimi et al.
8,776,890 B2 7/2014 Basmajian et al.
8,783,343 B2 7/2014 Giroux et al.
8,863,853 B1 10/2014 Harris et al.
8,893,798 B2 11/2014 Hayter et al.
8,978,750 B2 3/2015 Noske et al.
9,068,417 B2 6/2015 Swenson et al.
9,133,692 B2 9/2015 Edwards
9,163,481 B2 10/2015 Noske et al.
9,175,552 B2 11/2015 Kitzman
9,222,335 B2 12/2015 Caminari et al.
9,309,745 B2 4/2016 Patel
9,353,600 B2 5/2016 Cong et al.
9,410,401 B2 8/2016 Cox et al.
9,453,380 B2 9/2016 Hardin, Jr. et al.
9,458,698 B2 10/2016 Harris et al.
9,482,076 B2 11/2016 Patel
9,518,439 B2 12/2016 Hallundbæk et al.
9,518,445 B2 12/2016 Noske
9,624,753 B2 4/2017 Stinessen et al.
9,810,343 B2 11/2017 Miller et al.
9,869,153 B2 1/2018 Moreno et al.
10,036,231 B2 7/2018 Murdoch
10,132,137 B2 11/2018 McDowell et al.
10,138,710 B2 11/2018 Noske
10,151,171 B2 12/2018 Noske et al.
10,208,568 B2 2/2019 Hill et al.
10,214,999 B2 2/2019 Noske et al.
10,233,725 B2 3/2019 Provost
10,273,767 B2 4/2019 Noske
10,352,131 B2 7/2019 Dockweiler
10,422,202 B2 9/2019 Kellner et al.
10,472,929 B2 11/2019 Miller et al.
10,502,024 B2 12/2019 Wang et al.
10,533,399 B2 1/2020 Ceccon De Azevedo et al.
10,550,667 B2 2/2020 Rushing et al.
10,605,047 B2 3/2020 Patel
10,697,270 B2 6/2020 Lundheim et al.
10,704,363 B2 7/2020 Johnson et al.
10,738,570 B2 8/2020 Miller et al.
10,781,665 B2 9/2020 Murdoch
10,890,048 B2 1/2021 Noske et al.
10,895,130 B2 1/2021 Noske et al.
10,947,798 B2 3/2021 Noske
10,954,749 B2 3/2021 Noske
11,111,759 B2 9/2021 Mudigere et al.
11,293,265 B2 4/2022 Burris et al.
11,346,183 B2 5/2022 Mair et al.
2009/0294124 A1 12/2009 Patel
2010/0175867 A1 7/2010 Wright et al.
2011/0056679 A1 3/2011 Rytlewski
2011/0168403 A1 7/2011 Patel
2011/0265987 A1 * 11/2011 Wright ..... E21B 23/06 166/154
2012/0018170 A1 1/2012 Basmajian et al.
2012/0285702 A1 11/2012 Rytlewski
2020/0115992 A1 4/2020 Wang et al.
2020/0141211 A1 5/2020 Franklin et al.
2020/0270966 A1 8/2020 Moyes et al.
2020/0291749 A1 9/2020 Johnson et al.
2021/0040816 A1 2/2021 Hiorth et al.
2021/0381326 A1 12/2021 Inglis et al.
2022/0170343 A1 6/2022 Brodie et al.

FOREIGN PATENT DOCUMENTS

WO 2014035420 A1 3/2014
WO 2015094266 A1 6/2015
WO 2018035187 A1 2/2018
WO 2020068466 A1 4/2020
WO 2020219435 A1 10/2020
WO 2020231415 A1 11/2020

* cited by examiner

ELECTRONIC RUPTURE DISC WITH ATMOSPHERIC CHAMBER

CROSS-REFERENCE TO RELATED APPLICATION

The present document is the National Stage Entry of International Application No. PCT/US2021/018451, filed Feb. 18, 2021, which is based on and claims priority to U.S. Provisional Patent Application Ser. No. 62/978,154, filed Feb. 18, 2020, which is incorporated herein by reference in its entirety.

BACKGROUND

In a variety of well related applications, downhole tools are actuated to perform desired functions. For example, packers, valves, and other downhole tools may be selectively actuated at specific times during a downhole procedure and/or at specific locations within a wellbore. Several types of mechanisms have been employed to enable actuation of the tool at the desired time and/or location.

For example, rupture discs have been employed to control actuation of one or more downhole tools. Rupture discs avoid premature actuation of the downhole tool before a predetermined level of pressure is applied. Once sufficient pressure is applied, the disc ruptures, which allows fluid pressure to facilitate activation of the downhole tool. There is a need for such rupture discs to be included in an actuation system having a portable and modular design to allow assembly of the actuation system into multiple housings on a variety of downhole tools.

SUMMARY

According to one or more embodiments of the present disclosure, an electronic trigger system includes: a longitudinal housing including: a detection section; an electronics section; and an actuation section disposed therein; a pressure sensor disposed in the detection section, wherein the pressure sensor is configured to receive a predetermined pressure signal; and an electronic control board including at least one battery disposed in the electronics section, wherein the actuation section includes: a prefill chamber, a setting piston disposed in the prefill chamber, an actuation device, wherein a predetermined amount of prefilled fluid at hydrostatic pressure is trapped between the setting piston and the actuation device in the prefill chamber, at least one atmospheric chamber, wherein the actuation device isolates the prefilled fluid at hydrostatic pressure in the prefill chamber from the at least one atmospheric chamber; and a pressure port, wherein actuation occurs when, upon receipt of the predetermined pressure signal by the pressure sensor, the electronic control board transmits power to the actuation device, causing the prefilled fluid to flow through the actuation device and into the at least one atmospheric chamber using the pressure port.

According to one or more embodiments of the present disclosure, a system for use in a wellbore includes: at least one downhole tool including: a prefill chamber containing a predetermined amount of prefilled fluid at hydrostatic pressure; and a setting piston disposed in the prefill chamber such that the predetermined amount of prefilled fluid biases the setting piston in an initial position; and an electronic trigger system, including: a longitudinal housing including: a detection section; an electronics section; and an actuation section disposed therein; a pressure sensor disposed in the detection section, wherein the pressure sensor is configured to receive a predetermined pressure signal; and an electronic control board comprising at least one battery disposed in the electronics section, wherein the actuation section includes: an actuation device; at least one atmospheric chamber; and a pressure port that facilitates transmission of pressure to the actuation device, wherein the longitudinal housing of the electronic trigger system is coupled to the at least one downhole tool, and wherein, upon receipt of the predetermined pressure signal by the pressure sensor, the electronic control board transmits power to the actuation device, causing the prefilled fluid in the prefill chamber of the at least one downhole tool to flow through the actuation device of the electronic trigger system and into the at least one atmospheric chamber using the power port, thereby actuating the at least one downhole tool.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

Figure 1A:
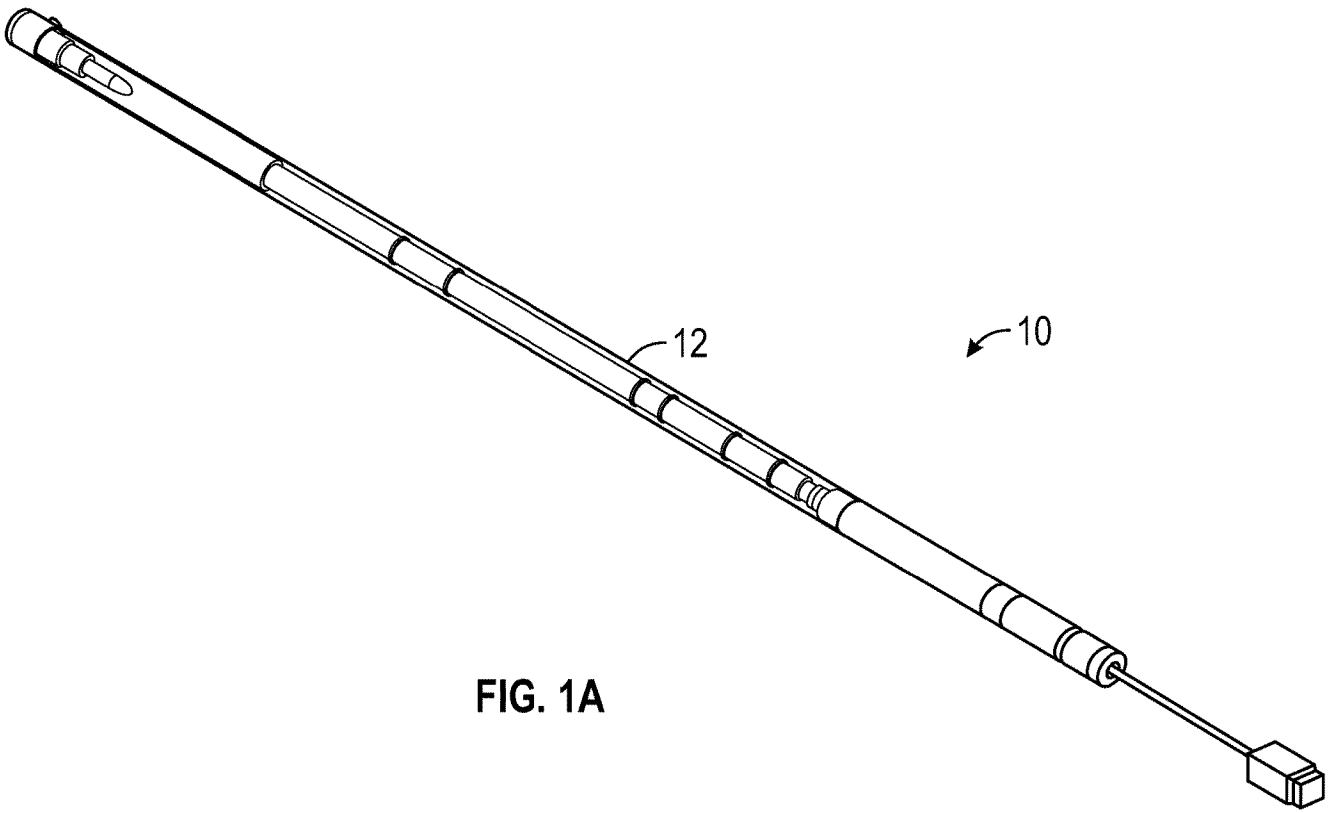
FIG. 1A is a perspective view of an electronic trigger system according to one or more embodiments of the present disclosure.

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

One or more embodiments of the present disclosure include systems and methods for electronically triggering the actuation of at least one downhole device. The electronic trigger system according to one or more embodiments of the present disclosure may be a universal electronic trigger system that facilitates adding electronic actuation to any component in the oil field. In operation, a signal may be sent from surface or from a downhole signal emitter to the electronic trigger system according to one or more embodiments of the present disclosure to create downhole movement required to set, actuate, or release at least one downhole tool. Further, the electronic trigger system according to one or more embodiments of the present disclosure may assume a modular design to facilitate the assembly of the electronic trigger system into multiple housings on different oil field tools. These oil field tools could be assets, such as running tools used to deploy a liner hanger, for example, that are designed to return back to the surface between jobs. The electronic trigger system according to one or more embodiments of the present disclosure may include products for a one-time use system. In one or more embodiments of the present disclosure, most of the electronics and housing of the electronic trigger system may be reused for future jobs to save costs. For example, according to one or more embodiments of the present disclosure, only the actuation device, e.g., the electronic rupture disc, and the on-board battery may be required to be changed between jobs. That is, when an asset is returned back to the surface between jobs, as previously described, the electronic trigger system according to one or more embodiments of the present disclosure may be retrofitted and reinstalled onto the returned asset after the on-board battery and the actuation device are replaced, as needed.

Referring generally to FIG. 1A, a perspective view of an electronic trigger system 10 according to one or more embodiments of the present disclosure is shown. As shown, the electronic trigger system 10 may assume a tubular shape and may have a longitudinal housing 12 according to one or more embodiments of the present disclosure.

Figure 1B:
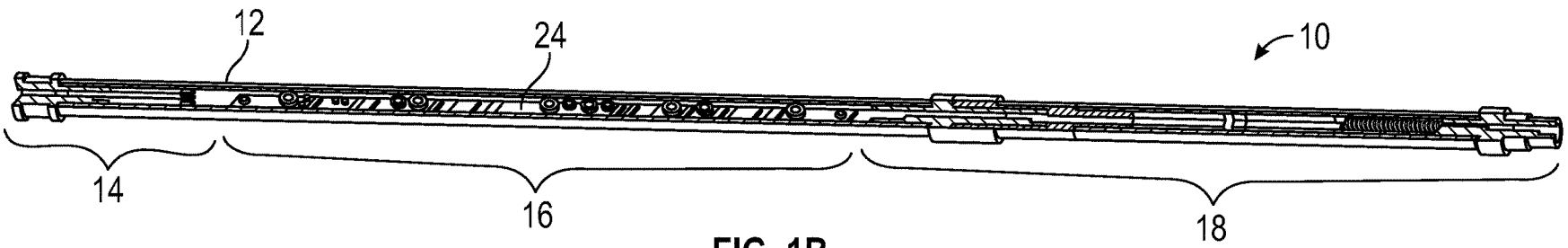
FIG. 1B is a cross-sectional view of an electronic trigger system according to one or more embodiments of the present disclosure.

Referring now to FIG. 1B, a cross-sectional view of an electronic trigger system 10 according to one or more embodiments of the present disclosure is shown. As shown, the longitudinal housing 12 of the electronic trigger system 10 may include a detection section 14, an electronics section 16, and an actuation section 18 disposed therein according to one or more embodiments of the present disclosure.

Figures 2A, 2B, 2C:
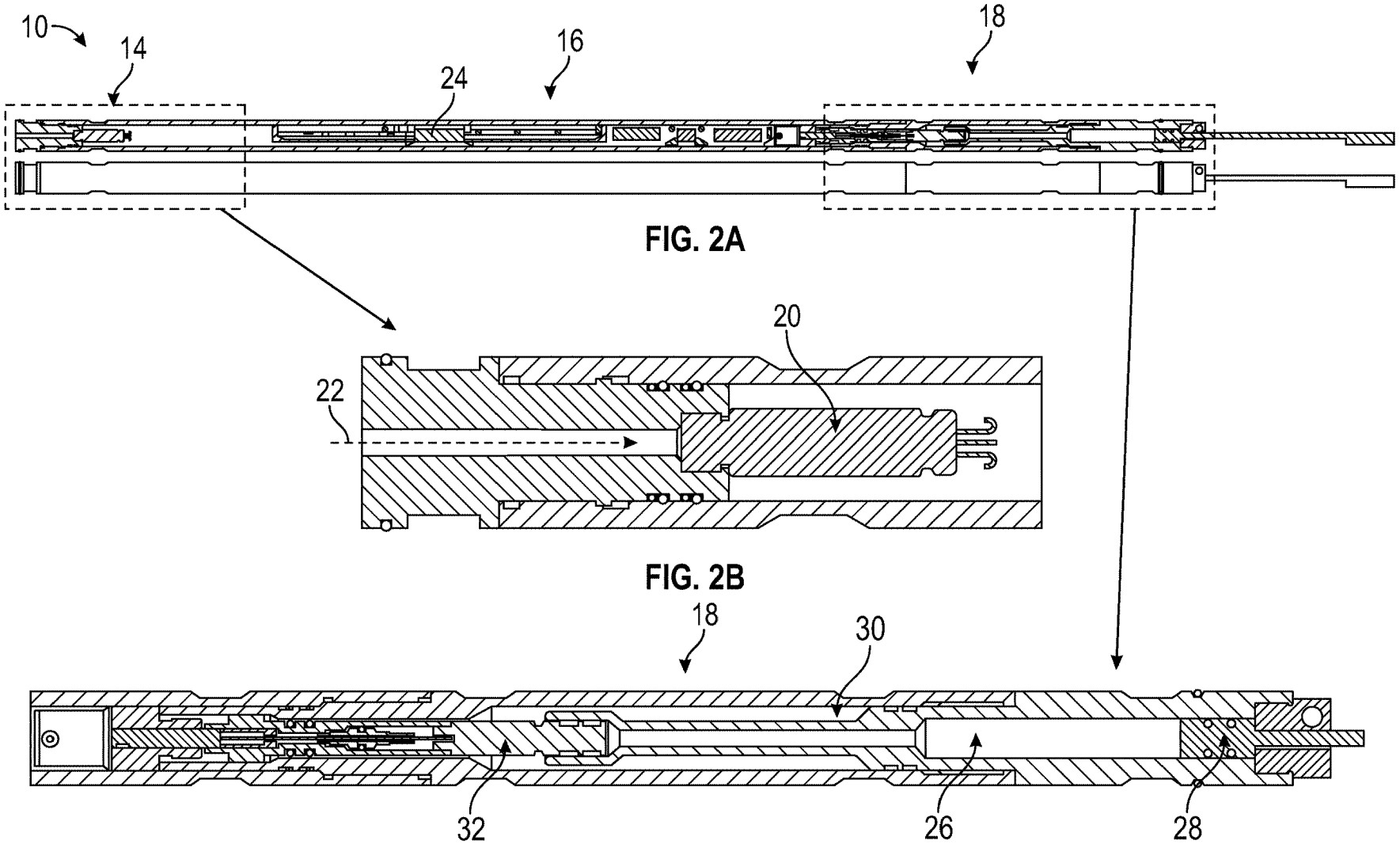
FIGS. 2A-2C show a layout of an electronic trigger system according to one or more embodiments of the present disclosure.

Referring now to FIGS. 2A-2C, a layout of an electronic trigger system 10 according to one or more embodiments of the present disclosure is shown. For example, FIG. 2A shows how a cross-sectional view of the electronic trigger system 10 according to one or more embodiments of the present disclosure may align with a corresponding perspective view of the electronic trigger system 10 according to one or more embodiments of the present disclosure. FIG. 2B shows a zoomed-in view of the detection section 14 of the electronic trigger system 10 according to one or more embodiments of the present disclosure. As shown in FIG. 2B, the detection section 14 of the electronic trigger system 10 may include a pressure transducer 20 or a pressure sensor, according to one or more embodiments of the present disclosure. In one or more embodiments of the present disclosure, the pressure sensor 20 is configured to receive a predetermined pressure signal 22. Advantageously, the pressure sensor 20 of the electronic trigger system 10 is configured to sense any pressure logic, even pressures as low as 100 psi, for example. In one or more embodiments of the present disclosure, the predetermined pressure signal may include a plurality of pressure pulses, for example. The pressure sensor 20 of the electronic trigger system 10 may receive the predetermined pressure signal 22 from a surface location according to one or more embodiments of the present disclosure. In other embodiments of the present disclosure, the pressure sensor 20 of the electronic trigger system 10 may receive the predetermined pressure signal 22 from a downhole signal emitter. In one or more embodiments of the present disclosure, the downhole signal emitter may be disposed on an adjacent downhole device, for example. While FIG. 2B shows a pressure sensor 20 that is configured to receive a predetermined pressure signal 22, the electronic trigger system 10 according to one or more embodiments of the present disclosure may include different sensors or detectors for sensing other types of signals including acoustic signals or electromagnetic telemetry signals, for example. In other embodiments of the present disclosure, such sensors or detectors may be wired to a permanent downhole gauge system, for example.

Referring back to FIG. 1B and FIG. 2A, the electronic trigger system 10 according to one or more embodiments of the present disclosure includes an electronics section 16. According to one or more embodiments of the present disclosure, the electronics section 16 includes an electronic control board 24 having at least one battery disposed thereon to provide on board power for the electronic trigger system 16. According to one or more embodiments of the present disclosure, the electronic control board 24 may also include a processor for decoding pressure signals received, including the predetermined pressure signal 22, memory, and a capacitor bank to provide power to an actuation device of the electronic trigger system 10, as further described below.

Still referring to FIG. 1B and FIG. 2A, the electronic trigger system 10 according to one or more embodiments of the present disclosure includes an actuation section 18. Referring now to FIG. 2C, the actuation section 18 includes a prefill chamber 26, a setting piston 28 disposed in the prefill chamber 26, an atmospheric chamber 30, and an actuation device 32, according to one or more embodiments of the present disclosure. While FIG. 2C shows that the actuation device 32 may be an electronic rupture disc according to one or more embodiments of the present disclosure, the actuation device 32 may also be a motor or solenoid, for example. Further, while FIG. 2C shows only one atmospheric chamber 30, the electronic trigger system 10 may include two or more atmospheric chambers 30 to facilitate alternating the direction of movement of one or more system components without departing from the scope of the present disclosure.

Figure 3:
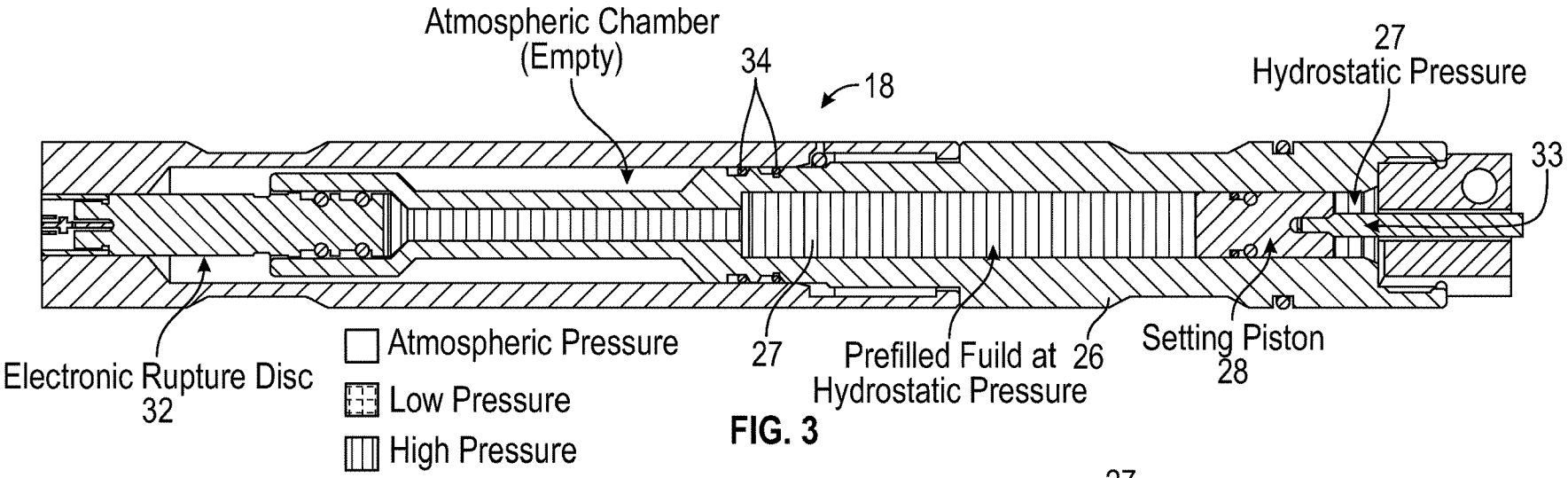
FIG. 3 shows an electronic trigger system sub-assembly in a run-in-hole configuration, according to one or more embodiments of the present disclosure.

Referring now to FIG. 3, an electronic trigger system 10 sub-assembly in a run-in-hole configuration is shown according to one or more embodiments of the present disclosure. Specifically, FIG. 3 shows the actuation section 18 of the electronic trigger system 10 in the run-in-hole configuration. As shown in FIG. 3, the prefill chamber 26 of the actuation section 18 may be filled with a predetermined amount of prefilled fluid at hydrostatic pressure 27. According to one or more embodiments of the present disclosure, the predetermined amount of prefilled fluid at hydrostatic pressure 27 may be trapped between the setting piston 28 and the actuation device 32 in the prefill chamber 26. Moreover, according to one or more embodiments of the present disclosure, the actuation device 32 isolates the prefilled fluid at hydrostatic pressure 27 in the prefill chamber 26 from the atmospheric chamber 30. According to one or more embodiments of the present disclosure, the actuation section 18 of the electronic trigger system 10 may also include a pressure port. For example, FIG. 3 shows an active pressure path through the pressure port of the electronic trigger system 10 at arrow 33, according to one or more embodiments of the present disclosure. According to one or more embodiments of the present disclosure, the pressure port and the setting piston 28 may share a common seal bore. In one or more embodiments of the present disclosure, an inflow control device may be installed in the pressure port for restricting flow of fluid through the pressure port, for example. According to one or more embodiments of the present disclosure, the actuation section 18 of the electronic trigger system 10 may also include a plurality of seals 34 located in front of the atmospheric chamber 30.

Figure 4:
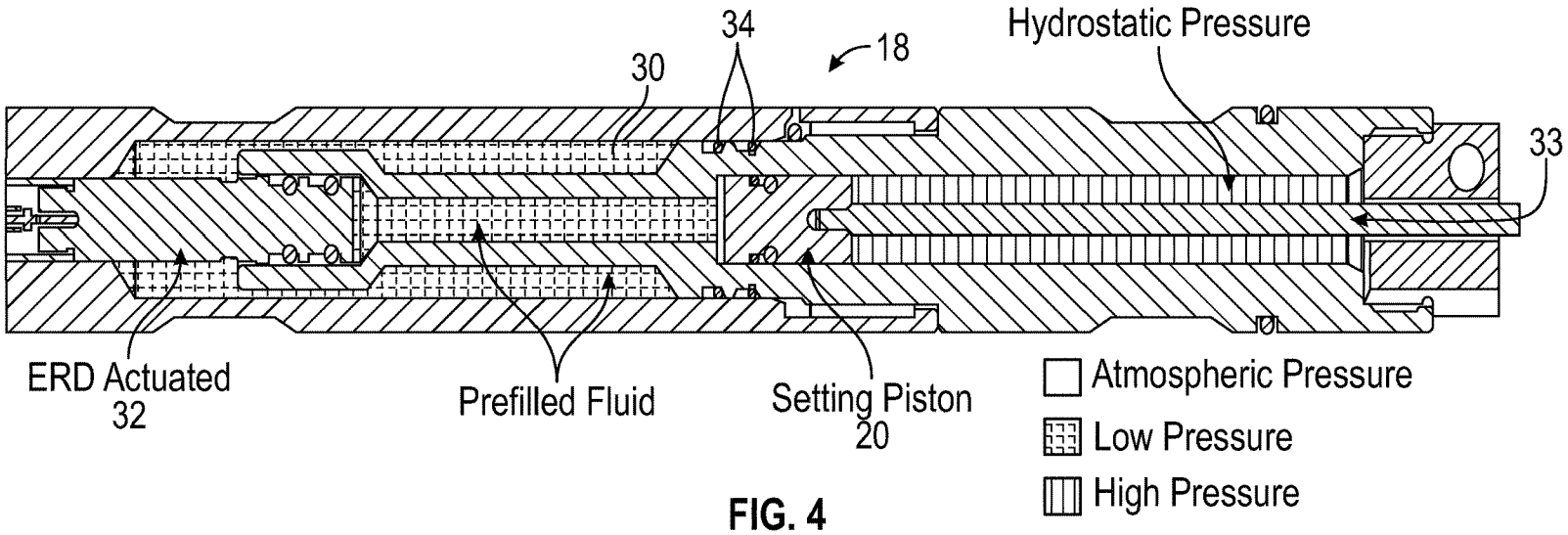
FIG. 4 shows an electronic trigger system sub-assembly after actuation, according to one or more embodiments of the present disclosure.

Referring to FIGS. 2A, 2B, 2C, and 3, actuation occurs when, upon receipt of the predetermined pressure signal 22 by the pressure sensor 20, the electronic control board 24 transmits power to the actuation device 32, causing the prefilled fluid 27 to flow through the actuation device 32 and into the at least one atmospheric chamber 30 using the pressure port, as previously described. According to one or more embodiments of the present disclosure, the flowing of the prefilled fluid 27 from the prefill chamber 26 into the at least one atmospheric chamber 30 causes the setting piston 28 to move linearly within the prefill chamber 26 toward the actuation device 32. That is, the push for movement of the setting piston 28 within the prefill chamber 26 is coming from the hydrostatic pressure fluid 27 along the active pressure path at arrow 33. For example, FIG. 4 shows an electronic trigger system 10 sub-assembly after actuation, according to one or more embodiments of the present disclosure. Indeed, as shown in FIG. 4, by the electronic control board 24 transmitting power to the actuation device 32, the actuation device 32 no longer isolates the prefilled fluid at hydrostatic pressure 27 in the prefill chamber 26 from the atmospheric chamber 30. As a result, the prefill fluid at hydrostatic pressure 27 within the prefill chamber 26 floods the atmospheric chamber 30. The transfer of prefill fluid 27 from the prefill chamber 26 into the atmospheric chamber 30 pulls the setting piston 28 to the left, creating the required movement to actuate the accompanying downhole tool, for example. As previously described, the electronic trigger system 10 may include two or more atmospheric chambers 30 to facilitate alternating the direction of movement of the setting piston 28 without departing from the scope of the present disclosure.

Figure 5:
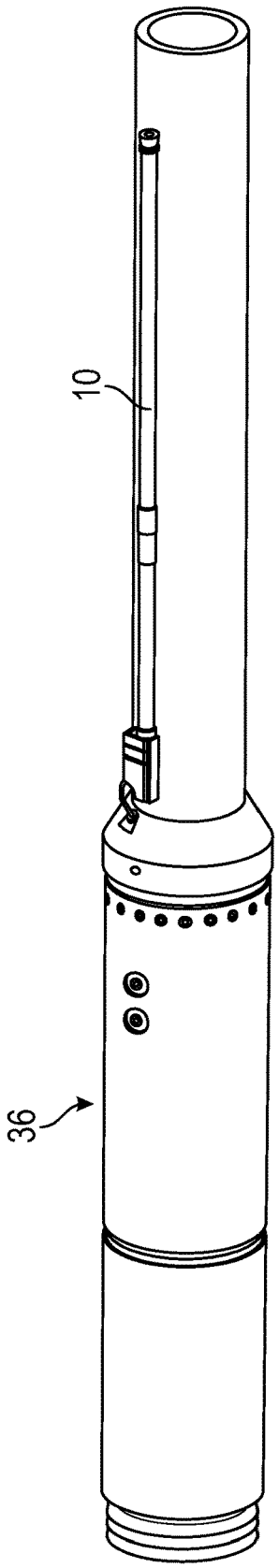
FIG. 5 shows an electronic trigger system coupled to a hydrostatic packer, according to one or more embodiments of the present disclosure.

A system for use in a wellbore according to one or more embodiments of the present disclosure includes a completion having at least one downhole tool and the electronic trigger system 10, as previously described. According to one or more embodiments of the present disclosure, the longitudinal housing 12 of the electronic trigger system 10 may be coupled to the at least one downhole tool of the completion for actuation of the at least one downhole tool. Referring now to FIG. 5, the electronic trigger system 10 according to one or more embodiments of the present disclosure may be coupled to a hydrostatic packer 36 as the downhole tool, for example. According to one or more embodiments of the present disclosure, the electronic trigger system 10 coupled to the hydrostatic packer 36 may employ an electronic rupture disc as the actuation device 32 for remote activation of the hydrostatic packer 36, for example. According to one or more embodiments of the present disclosure, the longitudinal housing 12 of the electronic trigger system 10 is coupled to the hydrostatic packer 36 via an additional pressure line interface, for example. Advantageously, the pressure sensor 20 of the electronic trigger system 10 coupled to the hydrostatic packer 36 is configured to receive a predetermined pressure signal 22 that is specific for setting the hydrostatic packer 36. In this way, the system including the electronic trigger system 10 coupled to the hydrostatic packer 26 allows high pressure activities, such as fluid exchange with significant friction, without inadvertently activating the hydrostatic packer 36. Moreover, the system including electronic trigger system 10 coupled to the hydrostatic packer 26 may be a triple redundant system, according to one or more embodiments of the present disclosure. For example, as previously described, a specific pressure pulse logic or predetermined pressure signal 22 may be used to activate the electronic trigger system 10 to set the hydrostatic packer 36, according to one or more embodiments of the present disclosure. Alternatively, a pressure value may be used to rupture a burst disk to set the hydrostatic packer 36, or running a plug and applying additional pressure may enable hydraulic pressure fluid to set the hydrostatic packer 36, according to one or more embodiments of the present disclosure.

Figure 6:
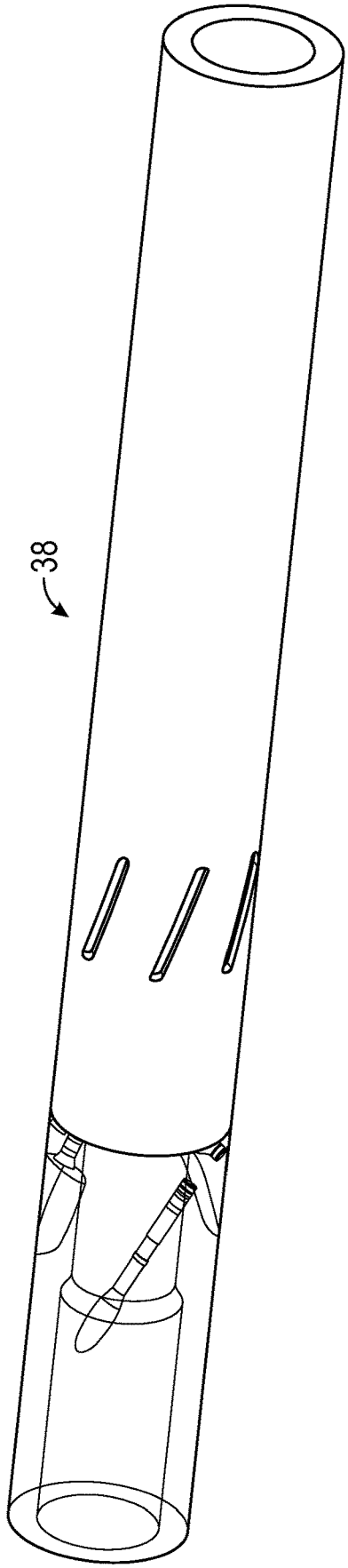
FIG. 6 shows an electronic trigger system coupled to a pressure actuatable circulation valve, according to one or more embodiments of the present disclosure.

Referring now to FIG. 6, an electronic trigger system 10 according to one or more embodiments of the present disclosure may be coupled to a pressure actuatable circulation valve 38 as the downhole tool, for example. According to one or more embodiments of the present disclosure, the system including the electronic trigger system 10 coupled to the pressure actuatable circulation valve 38 may include a redundant electronic trigger system as a second activation mechanism to the electronic trigger system.

According to one or more embodiments of the present disclosure, in the system including an electronic trigger system 10 coupled to the at least one downhole tool, the at least one downhole tool may include a pilot valve, for example. In such embodiments of the present disclosure, a stem portion of the setting piston 28 may be coupled to the pilot valve, and movement of the setting piston 28 may trigger an alternate path for pressure though the pilot valve to actuate the at least one downhole tool. According to one or more embodiments of the present disclosure, the at least one downhole tool may be an isolation valve including the pilot valve, for example.

Figure 7:
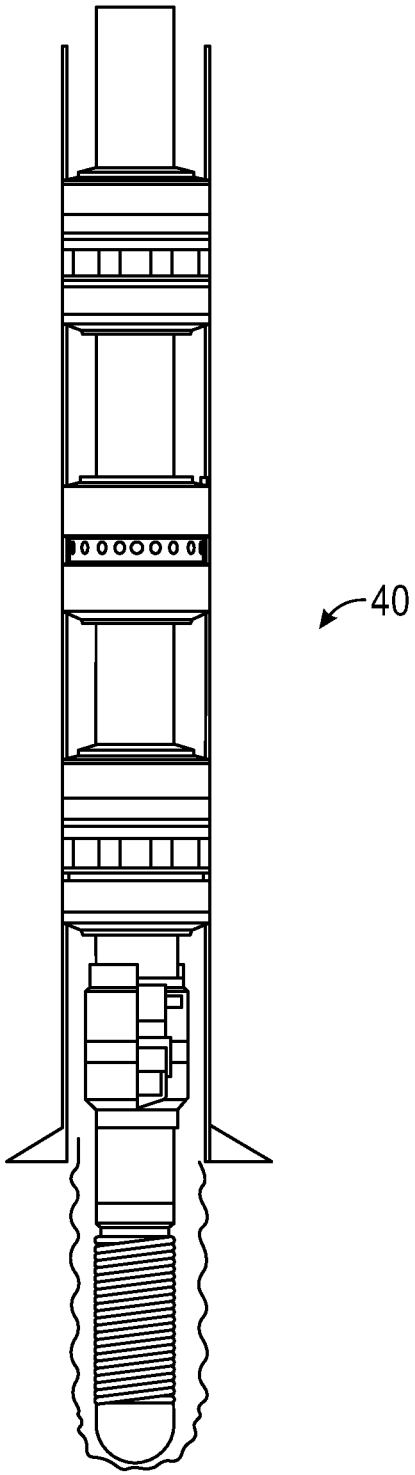
FIG. 7 shows a single trip completion including at least one downhole tool and an electronic trigger system according to one or more embodiments of the present disclosure.

Referring now to FIG. 7, a system for use in a wellbore according to one or more embodiments of the present disclosure may include a single trip completion 40 including at least one downhole tool including one or more of a packer, a sliding sleeve, and an isolation valve, for example, and an electronic trigger system 10 coupled to the at least one downhole tool in the single trip completion 40. One or more of the downhole tools of the single trip completion 40 may be equipped with the electronic trigger system 10 according to one or more embodiments of the present disclosure to simplify deployment and operation planning.

In a system for use in a wellbore according to one or more embodiments of the present disclosure, the system may include an electronic trigger system 10 coupled to at least one downhole tool. In one or more embodiments of the present disclosure, the prefill chamber 26 and the setting piston 28 may be disposed on the at least one downhole tool instead of being disposed in the electronic trigger system 10, for example. In such embodiments of the present disclosure, the prefill chamber 26 contains a predetermined about of prefilled fluid at hydrostatic pressure 27, and the setting piston 28 is disposed in the prefill chamber 26 such that the predetermined amount of prefilled fluid 27 biases the setting piston 28 in an initial position prior to actuation. Further, in such embodiments of the present disclosure, upon receipt of the predetermined pressure signal 22 by the pressure sensor 20, the electronic control board 24 of the electronic trigger system 10 transmits power to the actuation device 32, causing the prefilled fluid 27 in the prefill chamber 26 of the at least one downhole tool to flow through the actuation device of the electronic trigger system 10 and into the at least one atmospheric chamber 30, thereby actuating the at least one downhole tool.

Figure 8:
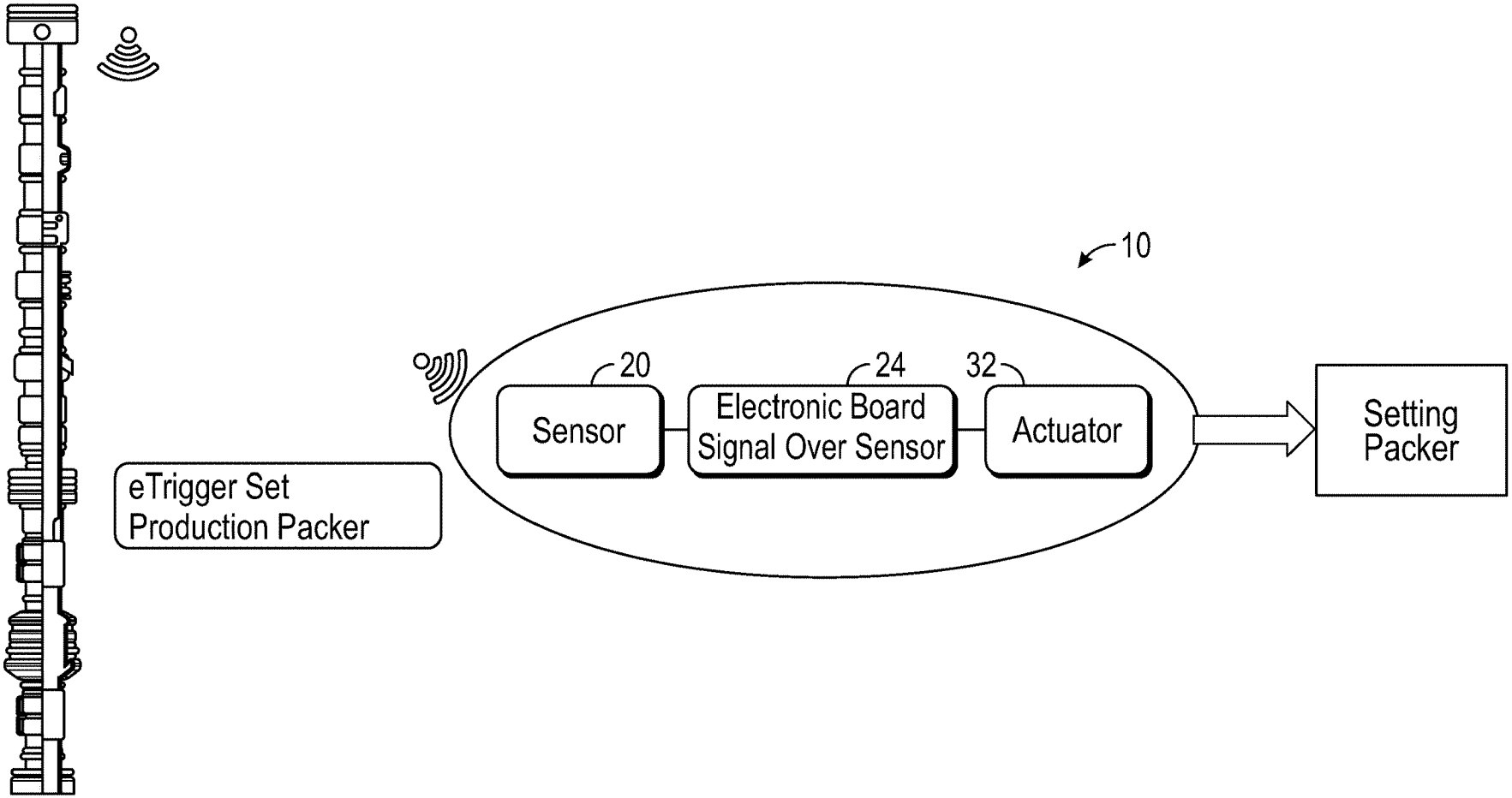
FIG. 8 shows a schematic for setting a packer using the electronic trigger system according to one or more embodiments of the present disclosure.

Referring now to FIG. 8, a schematic for setting a packer using the electronic trigger system 10 according to one or more embodiments of the present disclosure is shown. As shown, in one or more embodiments of the present disclosure, a signal sent from surface may be detected by a pressure sensor 20, decoded on an electronic control board 24, and power from the electronic control board 24 may be transmitted to the actuation device 32 to facilitate setting the packer. As shown in FIG. 8, a communication channel may be created between the signal from surface, the pressure sensor 20, the electronic control board 24, the actuation device 32, and the downhole tool, according to one or more embodiments of the present disclosure. In addition to setting a downhole tool, the method according to one or more embodiments of the present disclosure may be implemented to actuate or release a downhole tool, for example.

The electronic trigger system according to one or more embodiments of the present disclosure may be split into multiple longitudinal housings, or tubes, to allow for easy maintenance or reduce the length requirement for installation. The electronic trigger system according to one or more embodiments of the present disclosure may be paired with an extension to create additional actuation without having to double the amount of electronics downhole. Such a configuration may be used to enable the closing and opening of a downhole device, or to actuate two or more devices. In one or more embodiments of the present disclosure, the system may include an additional electronic trigger system loaded into the same housing of a downhole device, or allowing the electronics to directly connect to multiple actuation devices, e.g., electronic rupture discs, for actuation. In one or more embodiments of the present disclosure, the longitudinal housing of the electronic trigger system may be simplified or may be a 3D printed housing to lower the cost and size of the components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a wellbore, comprising:
- a completion comprising at least one downhole tool, wherein the at least one downhole tool comprises a pilot valve; and
- an electronic trigger system comprising:
  - a longitudinal housing comprising:
    - a detection section;
    - an electronics section; and
    - an actuation section disposed therein;
  - a pressure sensor disposed in the detection section, wherein the pressure sensor is configured to receive a predetermined pressure signal; and
  - an electronic control board comprising at least one battery disposed in the electronics section,
  - wherein the actuation section comprises:
    - a prefill chamber;
    - a setting piston disposed in the prefill chamber, wherein a stem portion of the setting piston is coupled to the pilot valve; and
    - an actuation device,
  - wherein a predetermined amount of prefilled fluid at hydrostatic pressure is trapped between the setting piston and the actuation device in the prefill chamber;
  - at least one atmospheric chamber,
  - wherein the actuation device isolates the prefilled fluid at hydrostatic pressure in the prefill chamber from the at least one atmospheric chamber; and
  - a pressure port,
  - wherein actuation occurs when, upon receipt of the predetermined pressure signal by the pressure sensor, the electronic control board transmits power to the actuation device, causing the prefilled fluid to flow through the actuation device and into the at least one atmospheric chamber using the pressure port,
- wherein the longitudinal housing of the system is coupled to the at least one downhole tool for actuation of the at least one downhole tool, and
- wherein movement of the setting piston triggers an alternate path for pressure through the pilot valve to actuate the at least one downhole tool.

2. The system of claim 1, wherein the pressure sensor is configured to receive the predetermined pressure signal from a surface location.

3. The system of claim 1, wherein the pressure sensor is configured to receive the predetermined pressure signal from a downhole signal emitter.

4. The system of claim 1, wherein the predetermined pressure signal comprises a plurality of pressure pulses.

5. The system of claim 1, wherein the pressure port and the setting piston share a common seal bore.

6. The system of claim 1, wherein the actuation device is an electronic rupture disc.

7. The system of claim 1, wherein the flowing of the prefilled fluid from the prefill chamber into the at least one atmospheric chamber causes the setting piston to move linearly within the prefill chamber toward the actuation device.

8. The system of claim 1, wherein an inflow control device is installed in the pressure port.

9. A method of actuating a downhole tool, comprising:

deploying a completion in a wellbore, the completion comprising:

at least one downhole tool comprising a pilot valve; and an electronic trigger system coupled to the at least one downhole tool, wherein the system comprises:

a longitudinal housing coupled to the at least one downhole tool for actuation of the at least one downhole tool, the longitudinal housing comprising:

a detection section;

an electronics section; and an actuation section disposed therein;

a pressure sensor disposed in the detection section, wherein the pressure sensor is configured to receive a predetermined pressure signal; and an electronic control board comprising at least one battery disposed in the electronics section, wherein the actuation section comprises:

a prefill chamber;

a setting piston disposed in the prefill chamber, wherein a stem portion of the setting piston is coupled to the pilot valve; and an actuation device, wherein a predetermined amount of prefilled fluid at hydrostatic pressure is trapped between the setting piston and the actuation device in the prefill chamber;

at least one atmospheric chamber, wherein the actuation device isolates the prefilled fluid at hydrostatic pressure in the prefill chamber from the at least one atmospheric chamber; and a pressure port, wherein actuation occurs when, upon receipt of the predetermined pressure signal by the pressure sensor, the electronic control board transmits power to the actuation device, causing the prefilled fluid to flow through the actuation device and into the at least one atmospheric chamber using the pressure port;

detecting the predetermined pressure signal by the pressure sensor;

decoding the predetermined pressure signal on the electronic control board;

transmitting power from the electronic control board to the actuation device; and actuating the at least one downhole tool by flowing the prefilled fluid through the actuation device and into the at least one atmospheric chamber using the pressure port, wherein movement of the setting piston triggers an alternate path for pressure through the pilot valve to actuate the at least one downhole tool.

10. The method of claim 9, wherein the pressure sensor is configured to receive the predetermined pressure signal from a surface location.

11. The method of claim 9, wherein the pressure sensor is configured to receive the predetermined pressure signal from a downhole signal emitter.

12. The method of claim 9, wherein the predetermined pressure signal comprises a plurality of pressure pulses.

13. The method of claim 9, wherein the actuation device is an electronic rupture disc.

14. The method of claim 9, wherein the pressure port and the setting piston share a common seal bore.

15. The method of claim 9, wherein the flowing of the prefilled fluid from the prefill chamber into the at least one atmospheric chamber causes the setting piston to move linearly within the prefill chamber toward the actuation device.

16. The method of claim 9, wherein an inflow control device is installed in the pressure port.

* * * * *